US010332732B1

(12) United States Patent
Smith et al.

(10) Patent No.: US 10,332,732 B1
(45) Date of Patent: Jun. 25, 2019

(54) IMAGE INTENSIFIER WITH STRAY PARTICLE SHIELD

(71) Applicant: Eagle Technology, LLC, Melbourne, FL (US)

(72) Inventors: Arlynn W. Smith, Blue Ridge, VA (US); Dan Chilcott, Buchanan, VA (US)

(73) Assignee: Eagle Technology, LLC, Melbourne, FL (US)

( * ) Notice: Subject to any disclaimer, the term of this patent is extended or adjusted under 35 U.S.C. 154(b) by 0 days.

(21) Appl. No.: 15/995,946

(22) Filed: Jun. 1, 2018

(51) Int. Cl.

| | |
|---|---|
| ***H01J 1/34*** | (2006.01) |
| ***H01J 31/50*** | (2006.01) |
| ***H01J 40/16*** | (2006.01) |
| ***H01J 43/02*** | (2006.01) |
| ***H01J 43/08*** | (2006.01) |
| ***H01J 43/12*** | (2006.01) |

(52) U.S. Cl.
CPC ..... *H01J 43/02* (2013.01); *H01J 1/34* (2013.01); *H01J 31/506* (2013.01); *H01J 40/16* (2013.01); *H01J 43/08* (2013.01); *H01J 43/12* (2013.01)

(58) Field of Classification Search
CPC .. H01J 43/02; H01J 43/08; H01J 43/12; H01J 1/34; H01J 40/16; H01J 31/506; H01J 43/04; H01F 7/0278
See application file for complete search history.

(56) References Cited

U.S. PATENT DOCUMENTS 3,299,306 A * 1/1967 Kapany ..... H01J 43/08 136/246
6,298,178 B1 10/2001 Day et al.
6,836,059 B2 12/2004 Smith
2004/0232403 A1 * 11/2004 Sillmon ..... H01J 9/12 257/10
2012/0112056 A1 * 5/2012 Brucker ..... H01J 49/4245 250/282
2019/0088393 A1 * 3/2019 Stresau ..... H01J 43/04

OTHER PUBLICATIONS

Macdonald, D., and A. Chevas, "The Use of Injection-Level Dependent Lifetime Measurements for Determining Solar Cell Parameters," Proc. 38th Annu. Australian New Zealand Sol. Energy Conf., pp. 494-500 (2000).
Pang, S.K., et al., "Effect of Trap Location and Trap-assisted Auger Recombination on Silicon Solar Cell Performance," IEEE Transactions on Electron Devices, vol. 42(4):662-668 (Apr. 1995).
Park, S., et al., "Influence of Carrier Lifetime on Performance of Silicon p-i-n Variable Optical Attenuators Fabricated on Submicrometer Rib Waveguides," Optics Express, vol. 18(11):1182-11291 (2010).

* cited by examiner

*Primary Examiner* — Joseph L Williams
*Assistant Examiner* — Jose M Diaz
(74) *Attorney, Agent, or Firm* — Edell, Shapiro & Finnan, LLC

(57) ABSTRACT

A light intensifier includes a semiconductor structure to multiply electrons and block stray particles (e.g., photons and/or ions). The semiconductor structure includes an electron multiplier region that is doped to generate a plurality of electrons for each electron that impinges a reception surface of the semiconductor structure, blocking regions that are doped to direct the plurality of electrons towards emissions areas of an emission surface of the semiconductor structure, and shielding regions that are doped to absorb stray particles that impinge the emission surface of the semiconductor structure.

20 Claims, 7 Drawing Sheets

VIEW A

VIEW A

VIEW A

VIEW A

IMAGE INTENSIFIER WITH STRAY PARTICLE SHIELD

BACKGROUND

Image intensifiers are used in low light (e.g., night vision) applications to amplify ambient light into a more visible image.

An image intensifier may be degraded by internal stray light or ion feedback, which may originate from an anode device such as a phosphor screen or other sensor device.

SUMMARY

A light intensifier includes a semiconductor structure to multiply electrons and block stray photons or ions (collectively referred to herein as "stray particles"). The semiconductor structure includes an electron multiplier region that is doped to generate a plurality of electrons for each electron that impinges a reception surface of the semiconductor structure, blocking regions that are doped to direct the plurality of electrons towards emissions areas of an emission surface of the semiconductor structure, and shielding regions that are doped to absorb stray particles that impinge the emission surface of the semiconductor structure and stop emission of the resulting electrons.

DETAILED DESCRIPTION

Disclosed herein are techniques to limiting effects of stray particles in semiconductor-based gain layer of an image intensifier.

Figure 1:
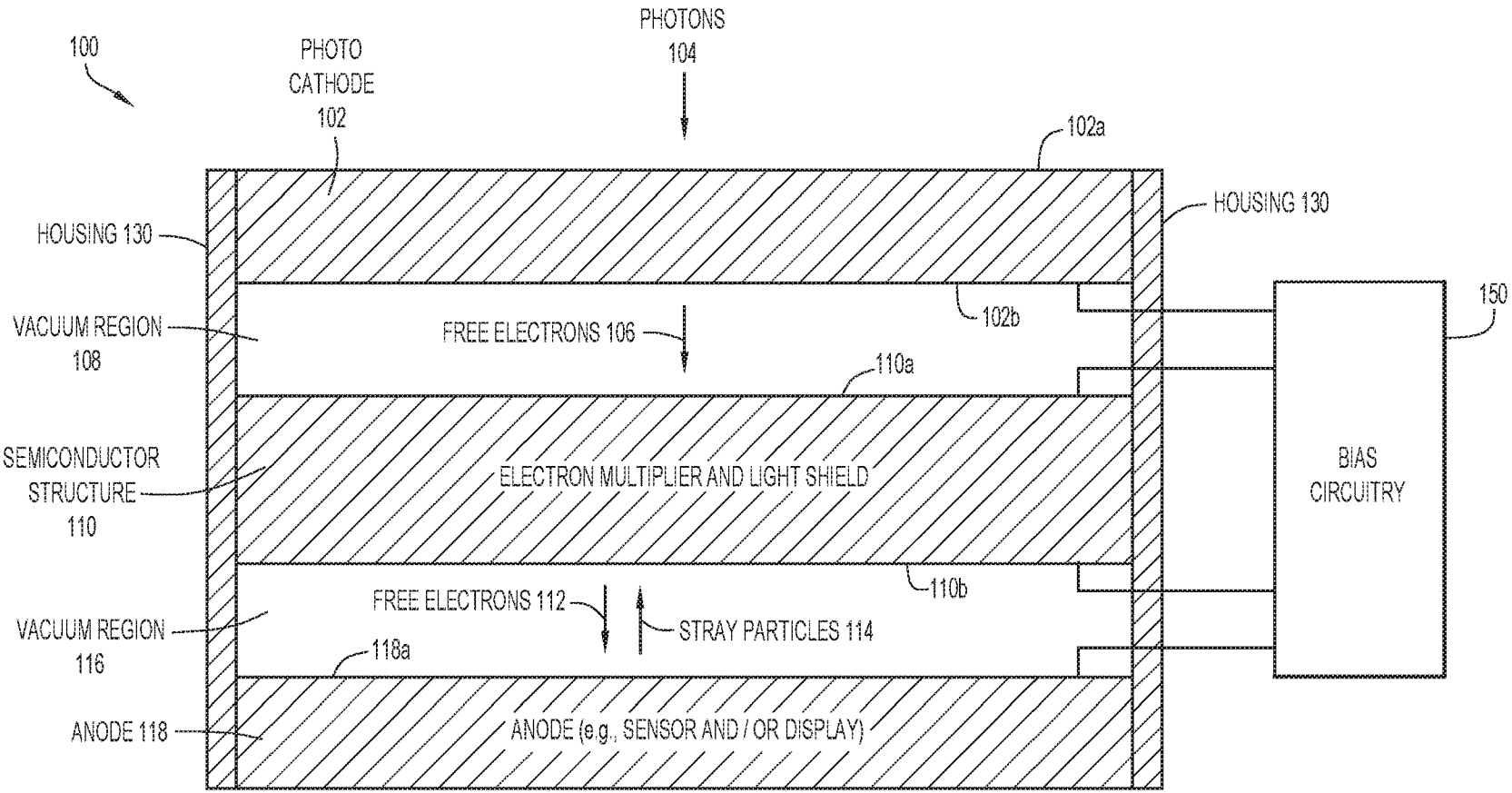
FIG. 1 is a cross-sectional view of an image-intensifier that includes a semiconductor structure configured as an electron multiplier and shield to absorb stray particles.

FIG. 1 is a cross-sectional view of an image-intensifier 100. Image-intensifier 100 may be configured as a night vision apparatus. Image-intensifier 100 is not, however, limited to a night vision apparatus.

Image intensifier 100 includes a photo-cathode 102 to convert photons 104 to electrons 106. Each photon 104 that impinges an input surface 102*a* has a probability to create a free electron 106. Free electrons 106 are emitted from an output surface 102*b*. Output surface 102*b* may be activated to a negative electron affinity state to facilitate the flow of electrons 106 from output surface 102*b*.

Photo-cathode 102 may be fabricated from a semiconductor material that exhibits a photo emissive effect, such as gallium arsenide (GaAs), GaP, GaInAsP, InAsP, InGaAs, and/or other semiconductor material. Alternatively, photo-cathode 102 may be a known Bi-alkali.

In an embodiment, a photo-emissive semiconductor material of photo-cathode 102 absorbs photons, which increases a carrier density of the semiconductor material, which causes the semiconductor material to generate a photo-current of electrons 106, which are emitted from output surface 102*b*.

Image intensifier 100 further includes a semiconductor structure 110 configured as an electron multiplier and shield to generate a plurality of free electrons 112 for each electron 106 that impinges a surface 110*a* of semi-conductor structure 110, and to absorb stray particles 114.

Semiconductor structure 110 may also be referred to herein as an electron multiplier, an electron amplifier, and/or an electron bombarded device (EBD). Semiconductor structure 110 may be configured to generate, for example and without limitation, several hundred free electrons 112 for each free electron 106 that impinges surface 110*a*.

Image intensifier 100 further includes an anode 118 to receive electrons 112 from semiconductor structure 110. Anode 118 may include a sensor to sense electrons 112 that impinge a surface 118*a* of anode 118. Anode 118 may include a phosphor screen to convert electrons 112 to photons. Anode 118 may include an integrated circuit having a CMOS substrate and a plurality of collection wells. In this example, electrons collected in the collection wells may be processed with a signal processor to produce an image, which may be provided to a resistive anode and/or an image display device.

Image intensifier 100 further includes a vacuum region 108 to facilitate electrons flow between photo cathode 102 and semiconductor structure 110.

Image intensifier 100 further includes a vacuum region 116 to facilitate electron flow between semiconductor structure 110 and anode 118.

Image intensifier 100 and/or portions thereof, may be configured as described in one or more examples below. Image intensifier 100 is not, however, limited to the examples below.

Image intensifier 100 further includes a bias circuit 150. In the example of FIG. 1, bias circuit 150 is configured to apply a first bias voltage between photo-cathode 106 and semiconductor structure 110, a second bias voltage between input surface 110*a* and an output surface 110*b* of semiconductor structure 110, and a third bias voltage between semiconductor structure 110 and anode 118 (e.g., to draw electrons 112 through semiconductor structure 110 towards a surface 118*a* of anode 118.

A peripheral surface of photo-cathode 102 may be coated with a conductive material, such as chrome, to provide an electrical contact to photo-cathode 102.

A peripheral surface of semiconductor structure 110 may be coated with a conducting material, such as chrome, to provide an electrical contact to one or more surfaces of semiconductor structure 110.

A peripheral surface of anode 118 may be coated with a conductive material, such as chrome, to provide an electrical contact to anode 118.

Image intensifier 100 may include a vacuum housing 130 to house photo-cathode 102, semiconductor structure 110, and anode 118.

Photo-cathode 102 and semiconductor structure 110 may be positioned such that output surface 102*b* of photo-cathode 102 is in relatively close proximity to input surface 110*a* of semiconductor structure 110 (e.g., less than approximately 10 millimeters, or within a range of approximately 100 to 254 microns).

Semiconductor structure 110 and anode 118 may be positioned such that emission surface 110*b* is in relatively close proximity to anode surface 118*a*. For example, if anode 118 includes an integrated circuit, the distance between emission surface 110*b* and anode surface 118*a* may be, without limitation, within a range of approximately 10 to 15 millimeters, or within a range of approximately 250 to 381 microns. If anode 118*a* includes a phosphor screen, the distance between emission surface 110*b* and sensor surface 118*a* may be, without limitation, approximately 10 millimeters.

Image intensifier 100, or portions thereof, may be configured as described in one or more examples below. Image intensifier 100 is not, however, limited to the examples below.

Figure 2:
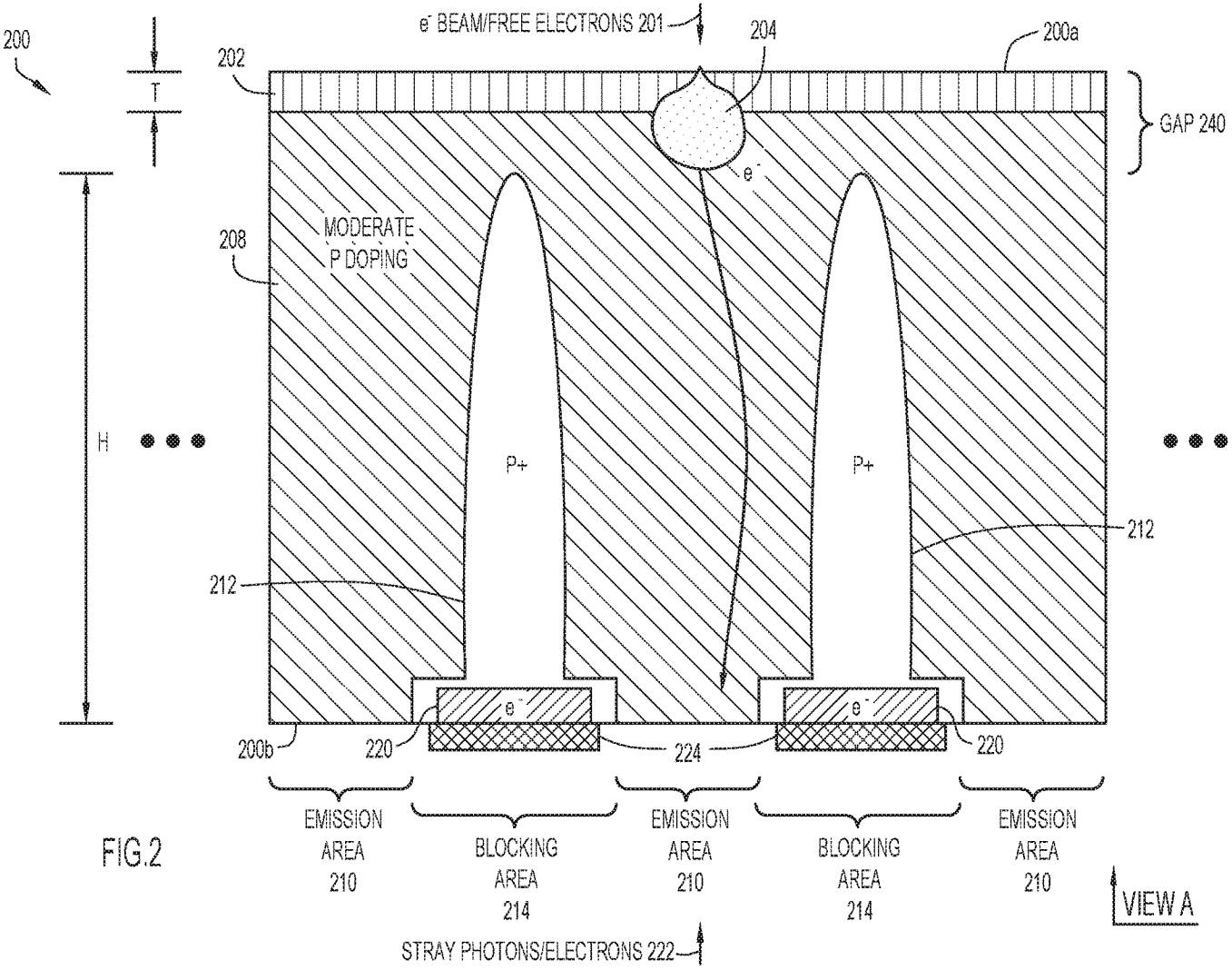
FIG. 2 is cross-sectional view of another semiconductor structure configured as an electron multiplier and shield, which may represent an example embodiment of the semiconductor structure of FIG. 1.

FIG. 2 is cross-sectional view of a semiconductor structure 200, configured as an electron multiplier and shield. Semiconductor structure 200 may represent an example embodiment of semiconductor structure 110 in FIG. 1.

Semiconductor structure 200 is doped to generate a plurality of free electrons 204 for each free electron 201 that impinges a surface 200*a* of semiconductor structure 200.

Semiconductor structure 200 includes first and second regions 202 and 208, which are doped to direct the flow of electrons 204 to emission areas 210 of emission surface 202*b*. Emission areas 210 may be activated to a negative electron affinity state to facilitate electron flow from emission regions 210. Second region 208 may also be referred to herein as a background region.

First region 202 is doped to force electrons 204 away from input surface 200*a* into semiconductor structure 200, thus inhibiting recombination of electron-hole pairs at input surface 200*a*. Inhibiting recombination of electron-hole pairs at input surface 200*a* ensures that more electrons flow through semiconductor structure 200 to emission surface 200*b*, thereby increasing efficiency.

Region 208 (alone and/or in combination with region 202), may also be referred to herein as an electron multiplier region.

Semiconductor structure 200 further includes regions 212, which are doped to repel free electrons 204. Regions 212 may also be referred to herein as blocking structures 212. Blocking structures 212 define blocking areas 214 of emission surface 200*b*, where electron flow into and out of semiconductor structure 200 is inhibited. Blocking regions 212 may help to maintain spatial fidelity. Blocking structures 212 may provide other benefits and/or perform other functions. Semiconductor structure 200 may provide suitable electron multiplication without blocking structures 212. Thus, in an embodiment, blocking structures 212 are omitted.

Stray particles 222 that impinge emission surface 200*b* of semiconductor structure 200 may convert to free electrons and corresponding holes. Thereafter, the free electrons may be emitted from emission surface 200*b* to contact anode 118 (FIG. 1). This may negatively impact recording and/or presentation of an image (e.g., as noise).

In FIG. 2, semiconductor structure 200 thus further includes regions 220, which are doped to reduce and/or minimize effects of stray particles 222. Regions 220 may also be referred to herein as shields 220. In an embodiment, shields 220 are doped to encourage re-combination of free electrons and holes. Shields 220 may be said to absorb stray particles 222.

Semiconductor structure 200 may further include a dielectric film 224 disposed over blocking areas 214, or a portion thereof.

Semiconductor structure 200 may include silicon and/or other semi conductive material such as, without limitation, gallium arsenide (GaAs).

In an embodiment, semiconductor structure 200 includes silicon and is relatively doped with a P-type dopant to generate a plurality of free electrons 204 for each free electron 201 that impinges a surface 200*a* of semiconductor structure 200. First doped region 202 may be doped with a P-type dopant such as boron or aluminum. First doped region 202 may be relatively heavily doped (e.g., $10^{19}$ parts per cubic centimeter). Second doped region 108 may be relatively moderately doped with a P-type dopant. Blocking structures 212 may be relatively heavily doped with a P-type dopant such as boron or aluminum (e.g., $10^{19}$ parts per cubic centimeter). Shields 220 may be doped with an N-type dopant, such as by diffusion or implanting.

Semiconductor structure 200 may have a thickness of, without limitation, approximately 20-30 microns). First doped region 128 may have a thickness T of approximately 10-15 nanometers. Blocking structures 212 may have a height H of approximately 24 microns.

A gap 240 may be provided between first doped region 202 and blocking structures 212. Gap 240 may be sized or dimensioned such that second doped region 212 does not interfere with the generation of electrons 204 at input surface 200*a*. This may provide semiconductor structure 200 with an effective electron multiplication area that equals or approaches 100% of an area of input surface 200*a*. Gap 240 may be, without limitation, approximately one micron.

Other suitable dopants, concentrations, dimensions, and/or semiconductor materials, such as GaAs, may be used, as will be readily apparent to one skilled in the relevant art(s).

In FIG. 2, regions between adjacent blocking structures 212 may be view as channels that extend from input surface 200*a* to emission areas 210. The channels have relatively wide cross-sectional areas near input surface 200*a*, and relatively narrow cross-sectional areas towards emission areas 210. The channels may act as funnels to direct electrons 204 to emission areas 210. The channels may also be referred to herein as an electron bombarded cells (EBCs). Semiconductor structure 200 may be configured with an array of EBCs, such as described below with reference to FIGS. 3 through 6. Semiconductor structure 200 is not, however, limited to the examples of any of FIGS. 3 through 6.

Figure 3:
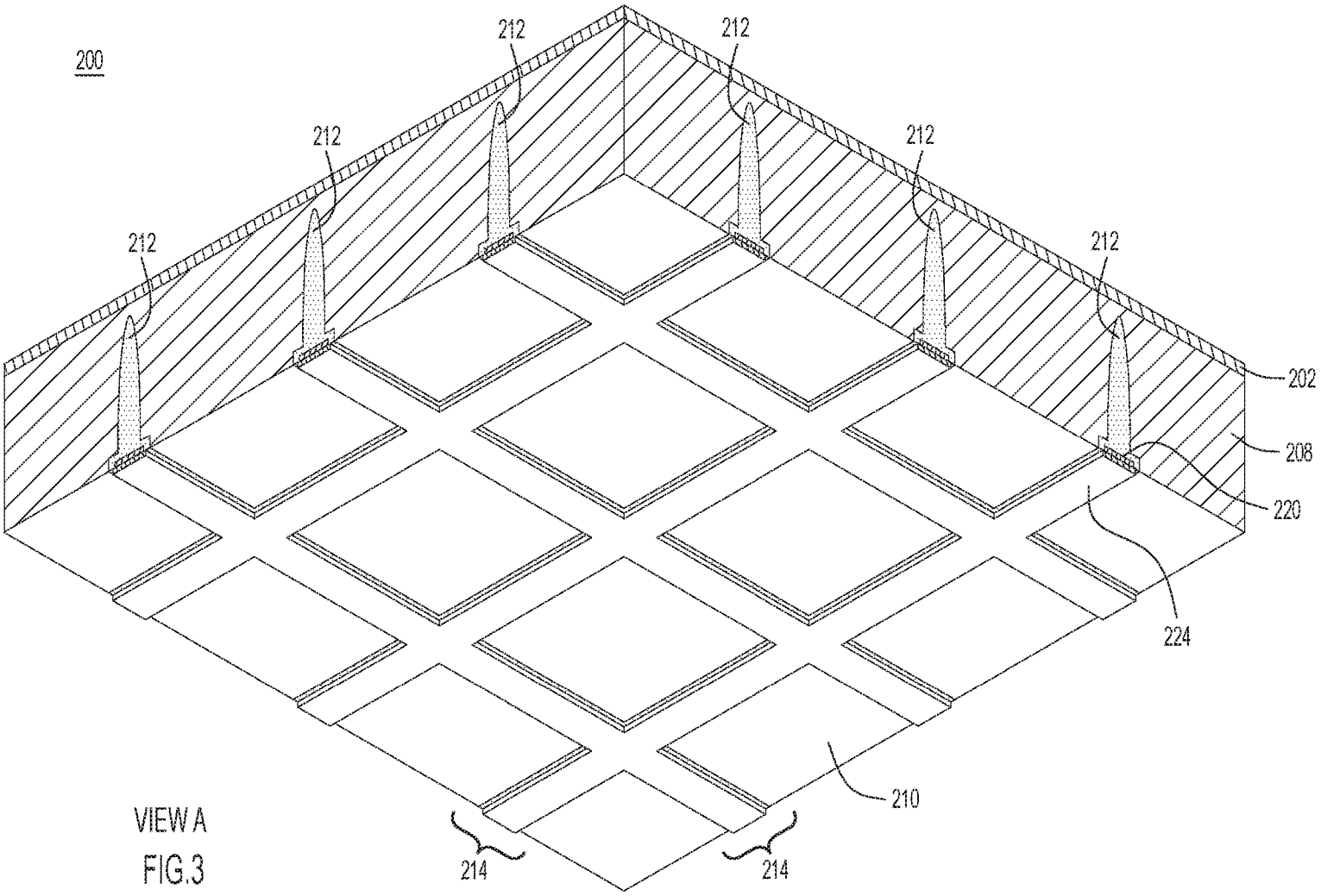
FIG. 3 is 3-dimensional cross-sectional perspective view of an example embodiment of the semiconductor structure of FIG. 2, in which the semiconductor structure includes multiple rows of parallel and perpendicular blocking structures to form an array of emission areas.

FIG. 3 is cross-sectional perspective view of an example embodiment of semiconductor structure 200, in which semiconductor structure 200 includes multiple rows of parallel and perpendicular blocking structures 212, to form an array of emission areas 210.

Figure 4:
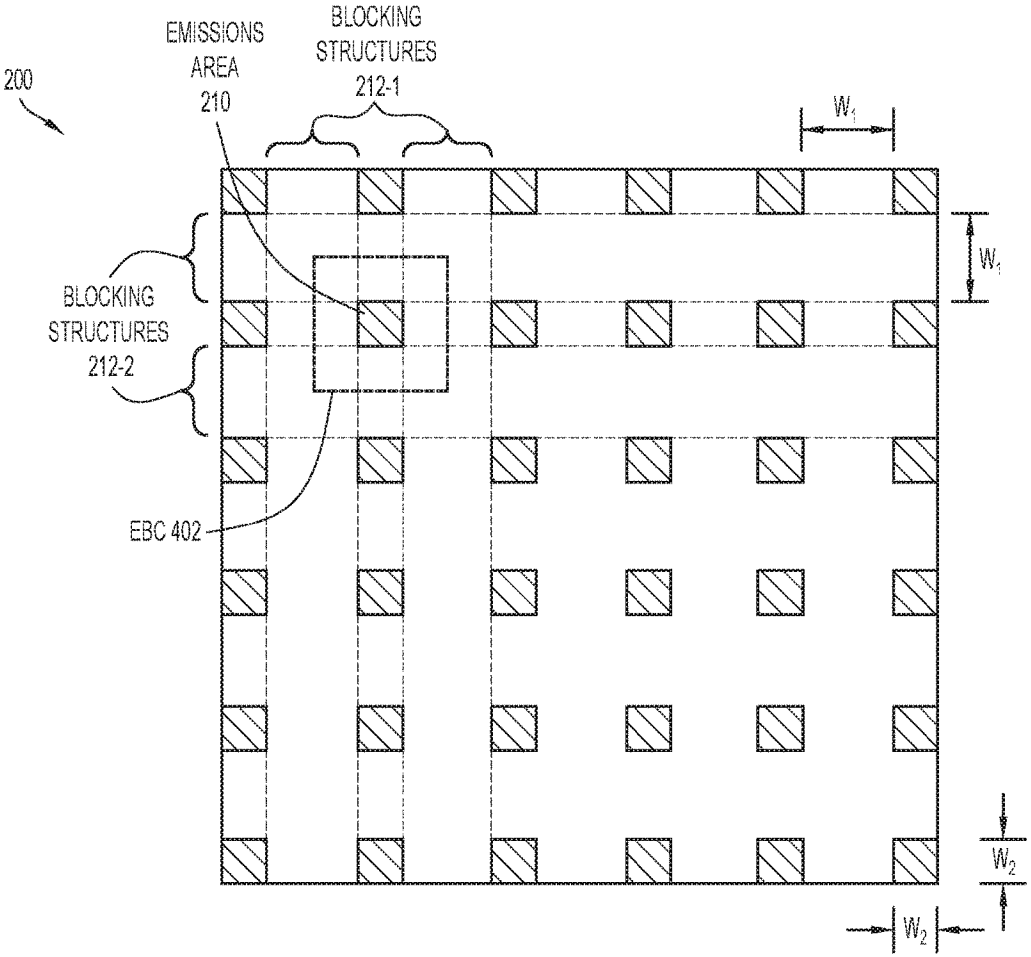
FIG. 4 is a 2-dimensional view an example embodiment of the semiconductor structure of FIG. 2 directed toward an emission surface of the semiconductor structure, in which shields are omitted for illustrative purposes.

FIG. 4 is view an example embodiment of semiconductor structure 200 directed toward emission surface 200*b* (View A in FIG. 3), in which shields 220 are omitted for illustrative purposes. In this embodiment, semiconductor structure 200 includes a first set of multiple rows of blocking structures 212-1, and a second set of multiple rows of blocking structures 212-2. Blocking structures 212-1 are perpendicular to blocking structures 212-2, to define emission areas 210, and EBCs 402.

Semiconductor structure 200 may be configured to generate, for example, several hundred electrons in each EBC 402 that receives an electron. The number of electrons emitted from emission areas 210 may thus be significantly greater than the number of electrons that impinge input surface 200*a*.

Figure 5:
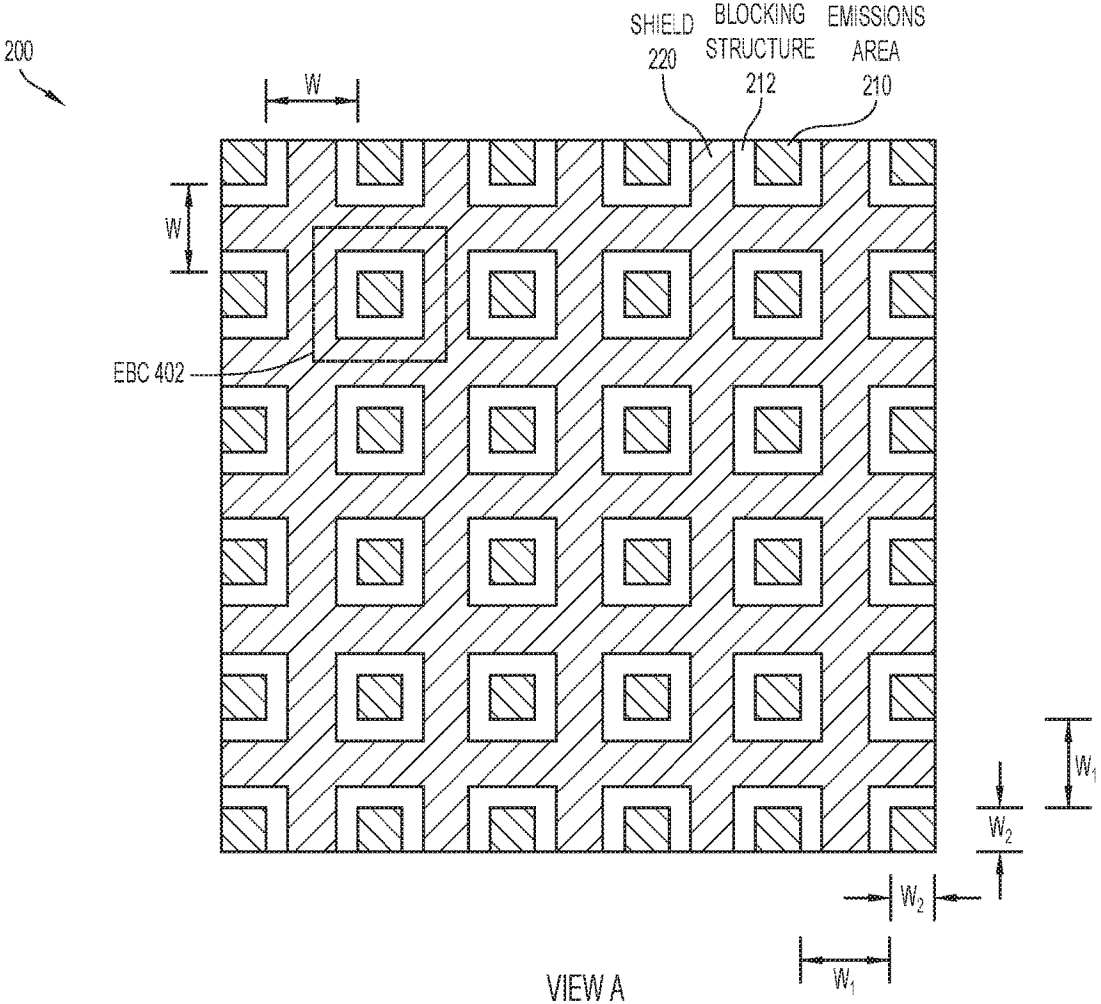
FIG. 5 is another view of the example embodiment of FIG. 4, in which shields are illustrated.

FIG. 5 is another view of the example embodiment of FIG. 4, in which shields 220 are illustrated. In an embodiment, a width $W_1$ of a base portion of blocking structures 212 is approximately 10-20 microns, and a width $W_2$ of emission areas 210 is approximately 0.5 to 2.0 microns. In this example, blocking areas 210 encompass more than 80% of an area of emission surface 200*b* of semiconductor structure 200. Semiconductor structure 200 is not, however, limited to these examples.

Figure 6:
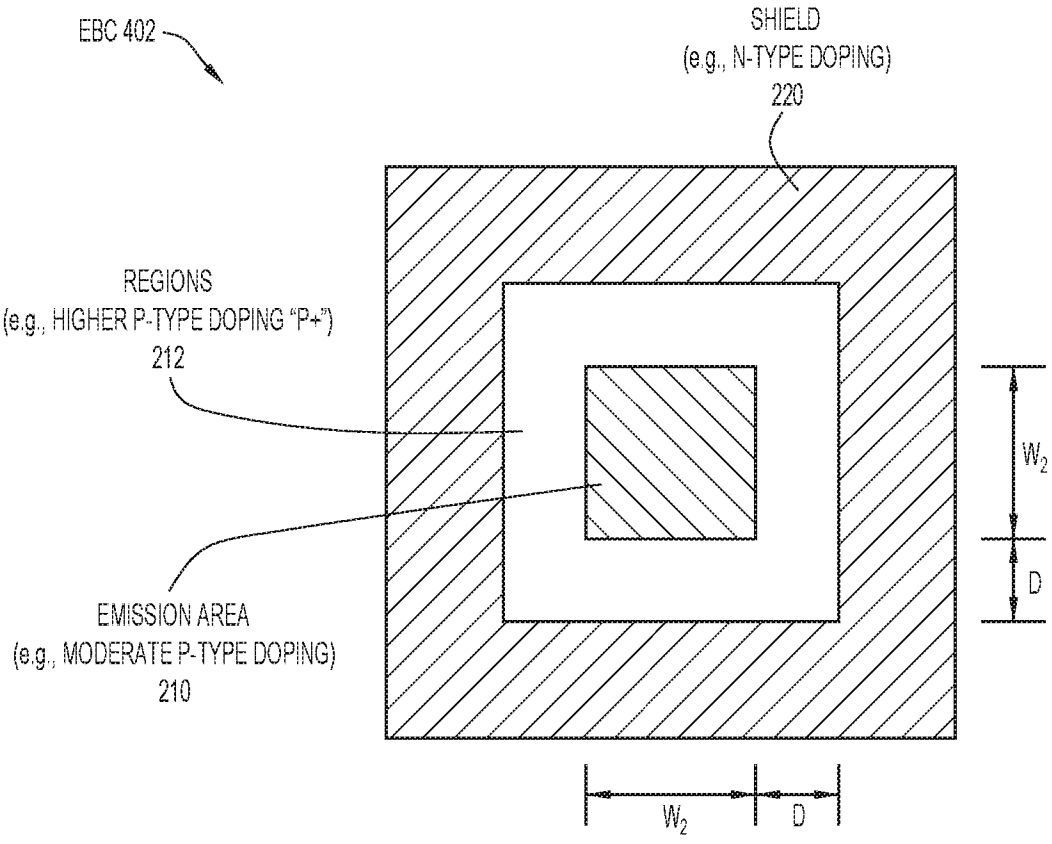
FIG. 6 depicts an expanded view of an electron bombarded cell of an electron multiplier of FIG. 4.

FIG. 6 depicts an expanded view of an EBC 402. In an embodiment, emission area 210 has a width $W_2$ of is approximately 1 micron. An exposed portion (e.g., ring) of blocking structure 212 extends a distance D of approximately 0.5 micron beyond emission area 210.

In the examples of FIGS. 3, 4, and 5, semiconductor structure 200 is illustrated as a square array of EBCs 402. Semiconductor structure 200 may be configured with other geometric (e.g., circular, rectangular, or other polygonal shape), which may depend upon an application (e.g., circular for lens compatibility, or square/rectangular for integrated circuit compatibility). In an embodiment, to replicate a conventional micro-channel plate used in an image intensifier tube, a square array 1000×3000 EBCs 402, or more, may be used. This may be useful, for example, to replicate a micro-channel plate of a conventional image intensifier tube.

In the examples of FIGS. 4 and 5, semiconductor structure 200 is depicted as a 6×6 array of EBCs 402. Semiconductor structure 200 is not, however, limited to this example. The number of EBCs 402 employed in an array may be more or less than in the foregoing example, and may depend on the size of the individual EBCs 402 and/or a desired resolution of an image intensifier.

In the examples of FIGS. 3 through 6, emission areas 210 are depicted as having square shapes. Emission areas 210 are not, however, limited to square shapes. Emission areas 210 may, for example, be configured as circles and/or other geometric shape(s).

Each EBC 402 and associated emission area 210 corresponds to a region of input surface 200*a* (FIG. 2), such that the array of EBCs 402 pixelate electrons received at input surface 200*a*.

Figure 7:
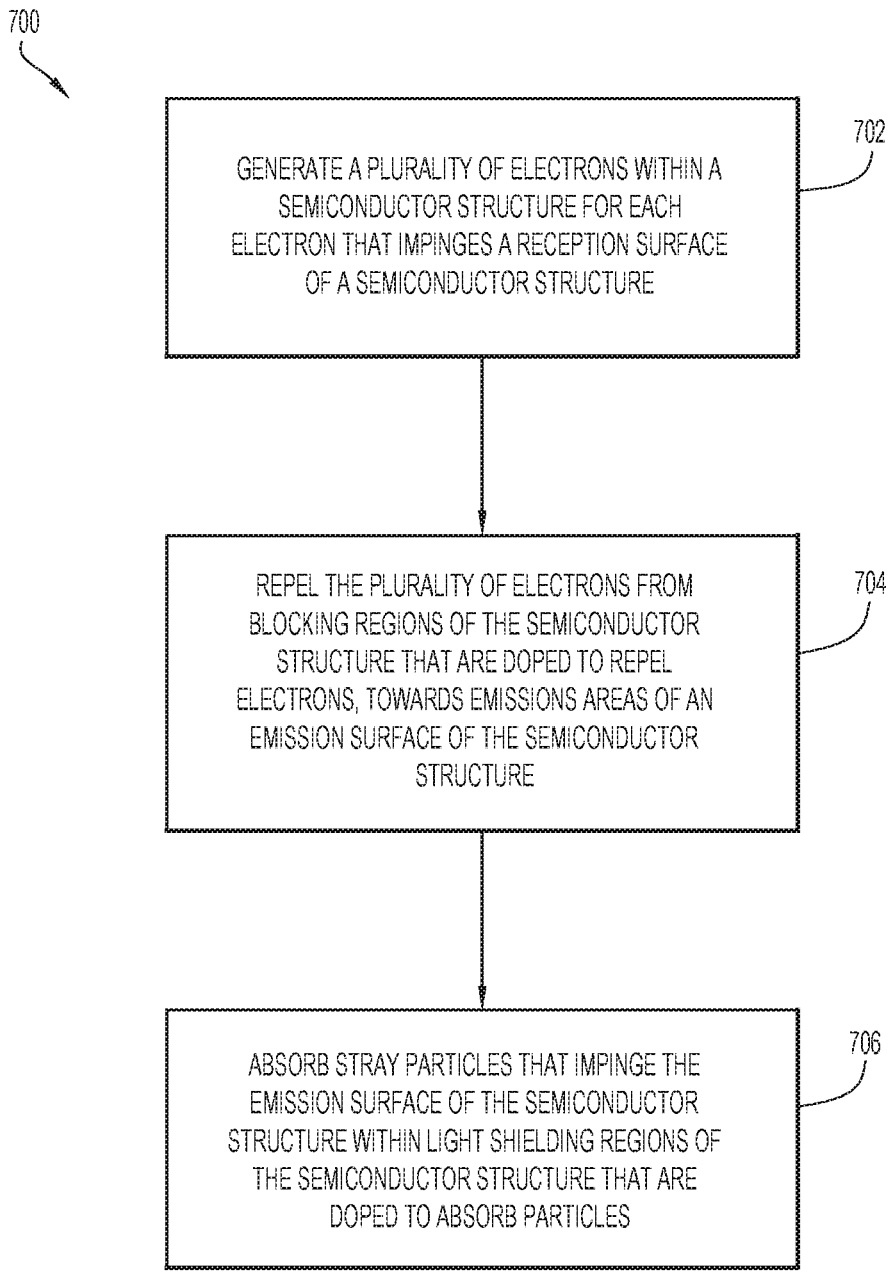
FIG. 7 is a flowchart of a method of intensifying an image and limiting effects of stray particles.

FIG. 7 is a flowchart of a method 700 of intensifying an image and limiting effects of stray particles. Method 700 may be performed with an apparatus disclosed herein. Method 700 is not, however, limited to example apparatus disclosed herein.

At 702, a plurality of electrons is generated within a semiconductor structure, for each electron that impinges a reception surface of a semiconductor structure, such as described in one or more examples herein.

At 704, the plurality of electrons is repelled from blocking regions of the semiconductor structure that are doped to repel electrons, towards emissions areas of an emission surface of the semiconductor structure, such as described in one or more examples herein.

At 706, stray particles that impinge the emission surface of the semiconductor structure are absorbed within shielding regions of the semiconductor structure, such as described in one or more examples herein.

Techniques disclosed herein may be implemented with/as passive devices (i.e., with little or no active circuitry or additional electrical connections).

Techniques disclosed herein are compatible with conventional high temperature semiconductor processes and wafer scale processing, including conventional CMOS and wafer bonding processes.

Methods and systems are disclosed herein with the aid of functional building blocks illustrating functions, features, and relationships thereof. At least some of the boundaries of these functional building blocks have been arbitrarily defined herein for the convenience of the description. Alternate boundaries may be defined so long as the specified functions and relationships thereof are appropriately performed. While various embodiments are disclosed herein, it should be understood that they are presented as examples. The scope of the claims should not be limited by any of the example embodiments disclosed herein. While a particular embodiment of the present invention has been shown and described in detail, adaptations and modifications will be apparent to one skilled in the art. Such adaptations and modifications of the invention may be made without departing from the scope thereof, as set forth in the following claims.

What is claimed is:

1. An apparatus, comprising:

a semiconductor structure that includes, an electron multiplier region that is doped to generate a plurality of electrons for each electron that impinges a reception surface of the semiconductor structure;

a blocking region that is doped to repel the plurality of electrons towards an emission area of an emission surface of the semiconductor structure; and a shielding region that is doped to absorb stray particles that impinge the emission surface of the semiconductor structure, wherein the stray particles include one or more of stray photons and stray ions.

2. The apparatus of claim 1, wherein:

the shielding region is doped to convert the stray particles to respective pairs of stray electrons and stray holes, and to recombine the stray electrons with the stray holes.

3. The apparatus of claim 1, wherein:

the blocking region and the electron multiplier region are doped with a P-type dopant; and the shielding region is doped with an N-type dopant.

4. The apparatus of claim 1, wherein:

the blocking region extends from the emission surface of the semiconductor structure towards the reception surface of the semiconductor structure; and the shielding region is within the blocking region.

5. The apparatus of claim 1, wherein:

the blocking region includes a plurality of blocking regions, each doped to repel the plurality of electrons towards respective adjacent emissions areas of the emission surface of the semiconductor structure; and the shielding region includes a plurality of shielding regions, each doped to absorb stray particles that impinge respective regions of the emission surface of the semiconductor structure.

6. The apparatus of claim 5, wherein:

the plurality of blocking regions include multiple rows of blocking channels that extend from the emission surface of the semiconductor structure toward the reception surface of the semiconductor structure; and the plurality of shielding regions include multiple shielding channels, each positioned within a respective one of the blocking channels.

7. The apparatus of claim 6, wherein:

the multiple rows of blocking channels includes a first and second rows of blocking channels; and the first row of blocking channels is perpendicular to the second row of blocking channels.

8. The apparatus of claim 1, wherein:

the semiconductor substrate is configured as an array of cells that are configured similar to one another; and a first one of the cells includes the shielding region, the blocking region within the shielding region, and the emission area within the blocking region.

9. The apparatus of claim 1, wherein:

the blocking region includes a 2-dimensional array of blocking areas on the emission surface of the semiconductor structure;

the emission area includes a 2-dimensional array of emission areas, each within a respective one of the blocking areas; and the shielding region encompasses a remaining portion of the emission surface of the semiconductor structure.

10. The apparatus of claim 1, further including:

a photo-cathode to convert protons to electrons and to direct the electrons toward the reception surface of the semiconductor structure; and an anode to receive the plurality of electrons from the semiconductor structure.

11. A method, comprising:

generating a plurality of electrons for each electron that impinges a reception surface of a semiconductor structure, within an electron multiplier region of a semiconductor structure;

repelling the plurality of electrons from blocking regions of the semiconductor structure that are doped to repel electrons, towards emissions areas of an emission surface of the semiconductor structure; and absorbing stray particles that impinge the emission surface of the semiconductor structure within shielding regions of the semiconductor structure that are doped to absorb photons, wherein the stray particles include one or more of stray photons and stray ions.

12. The method of claim 11, wherein the absorbing includes:

converting the stray particles to respective pairs of stray electrons and stray holes within the shielding regions; and recombining the stray electrons with the stray holes within the shielding regions.

13. The method of claim 11, wherein:

the blocking region and the electron multiplier region are doped with a P-type dopant; and the shielding region is doped with an N-type dopant.

14. The method of claim 11, wherein:

the blocking region extends from the emission surface of the semiconductor structure towards the reception surface of the semiconductor structure; and the shielding region is within the blocking region.

15. The method of claim 11, wherein:

the blocking region includes a plurality of blocking regions, each doped to repel the plurality of electrons towards respective adjacent emissions areas of the emission surface of the semiconductor structure; and the shielding region includes a plurality of shielding regions, each doped to absorb stray particles that impinge respective regions of the emission surface of the semiconductor structure.

16. The method of claim 15, wherein:

the plurality of blocking regions include multiple rows of blocking channels that extend from the emission surface of the semiconductor structure toward the reception surface of the semiconductor structure; and the plurality of shielding regions include multiple shielding channels, each positioned within a respective one of the blocking channels.

17. The method of claim 16, wherein:

the multiple rows of blocking channels includes a first and second rows of blocking channels; and the first row of blocking channels is perpendicular to the second row of blocking channels.

18. The method of claim 11, wherein:

the semiconductor substrate is configured as an array of similarly configured cells; and a first one of the cells includes the shielding region, the blocking region within the shielding region, and the emission area within the blocking region.

19. The method of claim 11, wherein:

the blocking region includes a 2-dimensional array of blocking areas on the emission surface of the semiconductor structure;

the emission area includes a 2-dimensional array of emission areas, each within a respective one of the blocking areas; and the shielding region encompasses a remaining portion of the emission surface of the semiconductor structure.

20. The method of claim 11, further including:

converting protons to electrons with a photo-cathode;

directing the electrons from the photo-cathode toward the reception surface of the semiconductor structure; and receiving the plurality of electrons from the semiconductor structure at an anode.

* * * * *